US007814957B2

(12) United States Patent
Crown

(10) Patent No.: US 7,814,957 B2
(45) Date of Patent: Oct. 19, 2010

(54) DOOR ASSEMBLY

(76) Inventor: David A Crown, 9285 Gary Ave., Waconia, MN (US) 55387

( * ) Notice: Subject to any disclaimer, the term of this patent is extended or adjusted under 35 U.S.C. 154(b) by 236 days.

(21) Appl. No.: 11/781,789

(22) Filed: Jul. 23, 2007

(65) Prior Publication Data

US 2008/0086947 A1 Apr. 17, 2008

Related U.S. Application Data

(60) Provisional application No. 60/833,021, filed on Jul. 24, 2006.

(51) Int. Cl.
*E05D 15/26* (2006.01)

(52) U.S. Cl. ..... 160/207; 160/213; 160/188

(58) Field of Classification Search ..... 160/207, 160/213, 188
See application file for complete search history.

(56) References Cited

U.S. PATENT DOCUMENTS

| | | | | | |
|---|---|---|---|---|---|
| 2,113,291 | A * | 4/1938 | Clark et al. | ..... | 160/189 |
| 3,103,969 | A * | 9/1963 | Kitley | ..... | 160/193 |
| 3,493,033 | A * | 2/1970 | McGirr | ..... | 160/207 |
| 3,557,317 | A | 1/1971 | Porter | ..... | 179/27 |
| 3,614,974 | A * | 10/1971 | Tajima | ..... | 160/188 |
| 3,698,464 | A * | 10/1972 | Scheitel | ..... | 160/188 |
| 4,177,854 | A * | 12/1979 | DeVore | ..... | 160/207 |
| 4,261,409 | A * | 4/1981 | De Vore | ..... | 160/207 |
| 4,637,446 | A * | 1/1987 | McQueen et al. | ..... | 160/207 |
| 5,601,131 | A * | 2/1997 | Morris | ..... | 160/207 |
| 5,882,099 | A * | 3/1999 | Salice | ..... | 312/328 |
| 6,033,176 | A | 3/2000 | Bartlett | ..... | 414/408 |
| 6,199,617 | B1 | 3/2001 | Schweiss | ..... | 160/193 |
| 6,431,049 | B1 | 8/2002 | Berg et al. | ..... | 91/420 |
| 6,868,305 | B2 | 3/2005 | Choi et al. | ..... | 700/200 |
| 6,883,273 | B2 * | 4/2005 | Kerkvliet | ..... | 49/199 |
| 6,886,866 | B1 | 5/2005 | Hool | ..... | 285/18 |
| 7,219,711 | B2 * | 5/2007 | Keller et al. | ..... | 160/213 |
| 2008/0086947 | A1 * | 4/2008 | Crown | ..... | 49/199 |

* cited by examiner

*Primary Examiner*—Blair M. Johnson
(74) *Attorney, Agent, or Firm*—Moss & Barnett

(57) ABSTRACT

A door assembly having a multi-panel door connected to a casing that is inserted into a structure opening. The multi-panel door can be operated by a control assembly operatively coupled to the casing and the multi-panel door. The multi-panel door can be a bi-fold door having an upper panel and lower panel operatively coupled together. The upper panel can be pivotally coupled to the casing at one end and pivotally coupled to a portion of the lower panel at its other end. The control assembly can control movement of the door between an open position and a closed position.

16 Claims, 12 Drawing Sheets

DOOR ASSEMBLY

PRIORITY

This application claims the benefit of U.S. Provisional Application Ser. No. 60/833,021, filed on Jul. 24, 2006, which is incorporated herein by reference.

BACKGROUND OF THE INVENTION

The present invention relates to doors and more particularly to hydraulically operated doors such as overhead bi-fold doors.

Large structural buildings, such as barns and aviation hangers, typically have large access openings to permit the egress of equipment such as tractors and planes. The large openings of these structures have typically been secured by doors of varying types. These doors have typically included doors that lift vertically either in a track, such as garage doors, or by rolling up upon themselves. Other conventional doors are operated in a horizontal fashion. These doors are either pivotally coupled to the structure or travel in horizontal tracks.

Another type of conventional door is the electrically operated bi-fold door. These types of doors generally consist of an upper panel and a lower panel centrally hinged together. The upper panel is hinged to the structure while the lower panel includes rollers set in a track typically attached to the structure. An electric motor and pulley system using cables pulls the lower panel up along the tracks. Upon movement of the lower panel, the centrally hinged portions of the upper and lower panels are forced away from the structure. These doors typically operate slowly and have the potential of falling should the motor, pulley system or cables fail.

Another conventional door is a single panel door that has an upper end hinged to a header of the structure and a free lower end that swings out away from the opening. This type of door can be operated by a hydraulic system secured to the door and the jambs of the structure. However, since the entire surface area of the door is positioned away from the structure it is capable of being acted upon by the wind. In certain weather conditions, the wind can damage the door and concurrently the structure.

BRIEF SUMMARY OF THE INVENTION

The invention is a hydraulic operated door assembly for a structure having a header and jambs defining an opening to the structure. The hydraulic operated door assembly includes a multi-panel door connected to a casing or door support that is inserted into the structure opening. The casing can include a horizontal truss and first and second vertical casing members disposed on ends of the horizontal truss. The door is operated by a hydraulic control assembly operatively coupled to the horizontal truss and the door.

In one embodiment of the invention, the door is a bi-fold door having an upper panel and lower panel operatively coupled together. The upper panel can be pivotally coupled to the generally horizontal truss assembly at one end and pivotally coupled to a portion of the lower panel at its other end. A free end of the lower panel can include guides capable of traveling in a track formed in the first and second vertical casing members.

The hydraulic control assembly can include one or more hydraulic piston and cylinders operatively coupled together and coupled between the generally horizontal truss assembly and the bi-fold door. The hydraulic control assembly can also include a manifold in fluid communication with the piston and cylinders to move them between a retracted position and an extended position. When the piston and cylinders are in the retracted position the door is in a closed position and when the piston and cylinders are in the extended position the door is in an open position.

The invention also includes a truss mountable to and extending generally along a header of a door opening. The truss supports the bi-fold door and a control assembly. The control assembly is pivotally coupled to and extends between the truss and a portion of the bi-fold door.

The above summary of the invention is not intended to describe each illustrated embodiment or every implementation of the invention. The figures in the detailed description that follow more particularly exemplify these embodiments.

BRIEF DESCRIPTION OF THE DRAWINGS

The invention will be better understood when consideration is given to the following detailed description thereof. Such description makes reference to the annexed drawings wherein.

Figure 1:
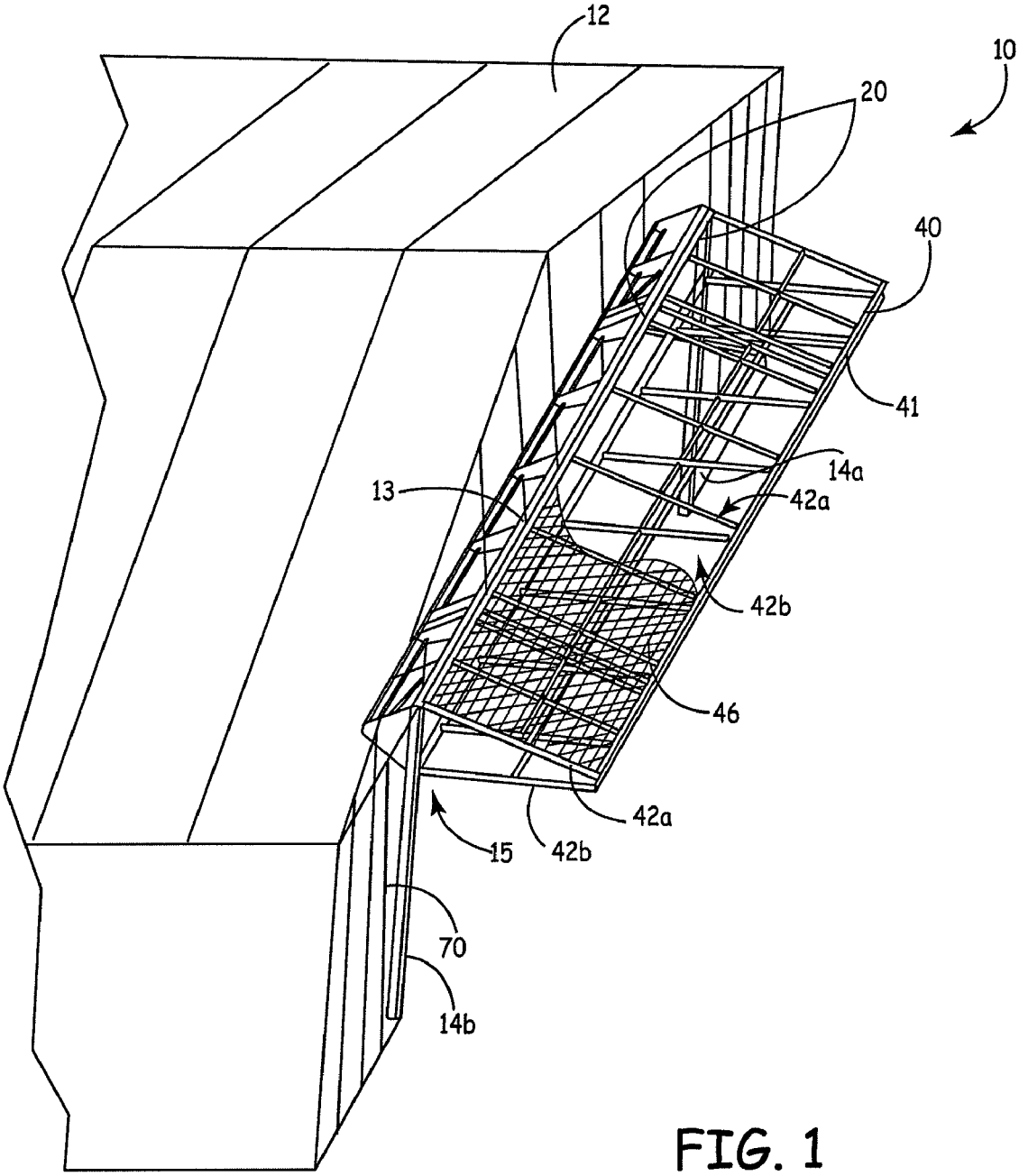
FIG. 1 is a perspective view of a hydraulic operated door assembly according to an example embodiment of the invention.

The preceding description of the drawings is provided for example purposes only and should not be considered limiting. The following detailed description is provided for more detailed examples of the invention. Other embodiments not disclosed or directly discussed are also considered to be within the scope and spirit of the invention. It is not the intention of the inventor to limit the scope of the invention by describing one or more example embodiments.

DESCRIPTION OF EXAMPLE EMBODIMENTS

The invention, indicated by the numeral 10 in example FIGS. 1-16, is a hydraulic operated door assembly that can be used to selectively open and close access openings in structures such as barns, aviation hangers, garages and the like. In one embodiment, the hydraulic operated door assembly 10 includes a casing or door support 20, a door or multi-panel door 40 and a control or hydraulic control assembly 70. Other components and features, such as alarms, sensors, windows, doors-within-a-door can also be used with the invention and should be considered to be within the spirit and scope of the invention.

Turning now to FIG. 1, the hydraulic operated door assembly 10 is illustrated coupled to a structure 12 that has a header 13 and a pair of jambs 14*a* and 14*b* that define an opening 15 of the structure 12. The casing or door support 20 of the hydraulic operated door assembly 10, upon which is operatively coupled the door 40, is disposed in the opening 15. The door 40 is operated by the hydraulic control system to move the door 40 between an open position and a closed position.

Figure 2:
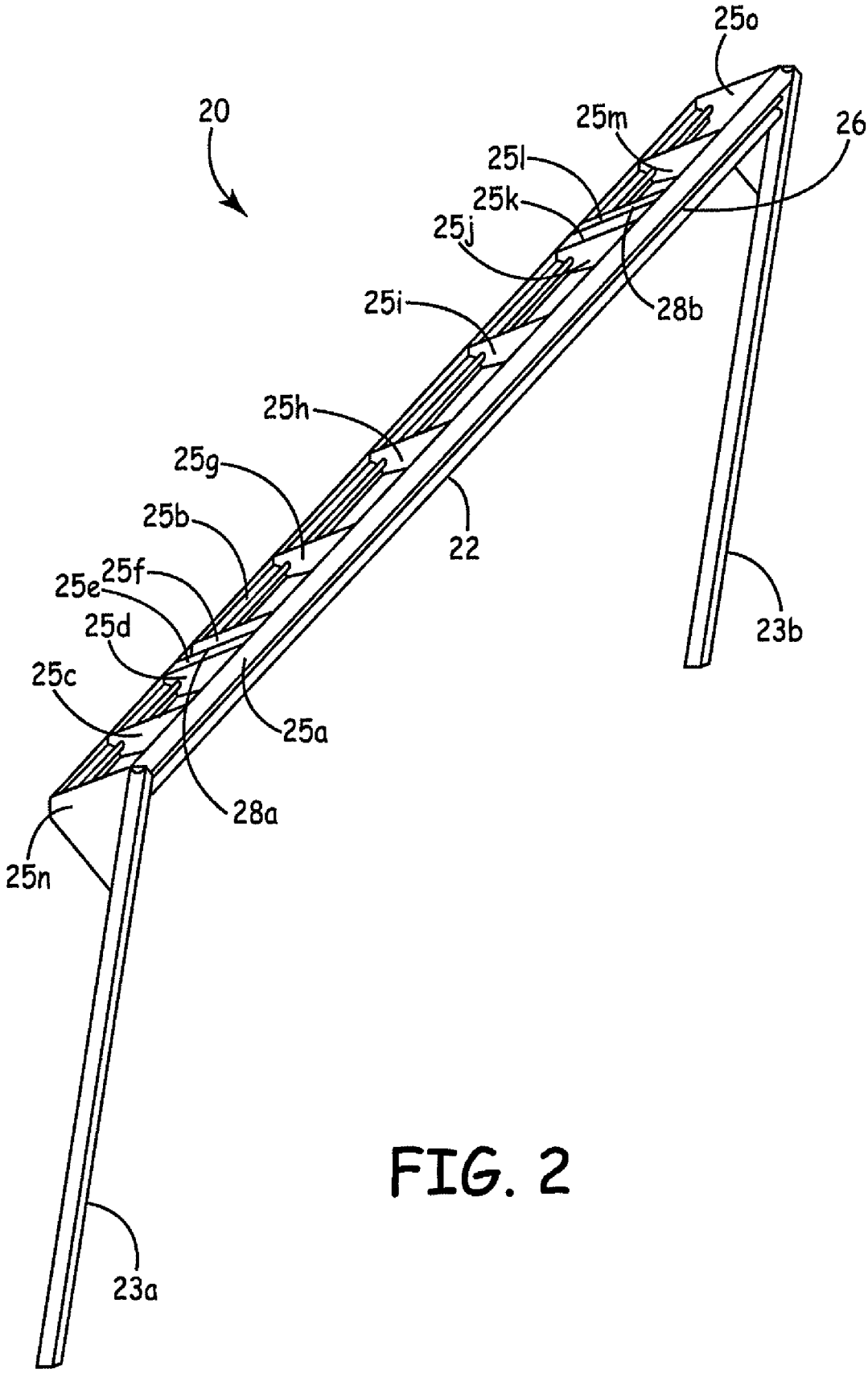
FIG. 2 is a perspective view of a door support according to an example embodiment of the invention.

As illustrated in FIG. 2, the casing or door support 20 can include a generally horizontal truss 22 and a first vertical casing member 23*a* and a second vertical casing member 23*b*. The first vertical casing member 23*a* and the second vertical casing member 23*b* can be coupled to ends of the generally horizontal truss 22. The casing or door support 20 can be positioned in the opening 15 such that the horizontal truss 22 is positioned in the interior of the structure 12 and proximate to the header 13 (as illustrated in FIG. 1). The truss 22 can extend generally a length of the header 13.

The vertical casing members 23*a* and 23*b* can be positioned proximate the jambs 14*a* and 14*b* of the structure 12. Once the casing or door support 20 is disposed in the opening 15 of the structure 12 it can be secured, fastened or fixed in place by fasteners such as screws and bolts. If the structure 12 is constructed from metal, the casing or door support 20 can be welded in place by any of a number of welding techniques. One skilled in the art will understand that the casing or door support 20 can be secured to the structure or ground by numerous techniques and devices such that those suggested herein would not be considered limiting.

Referring to FIG. 2, the generally horizontal truss 22 can include a top beam 25*a* disposed to ends of the vertical members 23*a* and 23*b*. The generally horizontal truss 22 can also include a rear beam 25*b* connected to the top beam 25*a* by a plurality of angled supports 25*c-m*. The rear beam 25*b* can also be supported by angled supports 25*n* and 25*o*. The angled supports 25*n* and 25*o* can extend between the rear beam 25*b* and the first vertical casing member 23*a* and the second vertical casing member 23*b* respectively. Continuing with FIG. 2, the casing or door support 20 can also include a forward beam 26 that can be disposed generally in front of the rear beam 25*b* and which can extend between and be coupled to the first vertical casing member 23*a* and the second vertical casing member 23*b*.

One skilled in the art will appreciate that the casing or door support 20 can be made from any type of material including steel tubing that is either welded together or coupled together with any type of fastener. The casing or door support 20 can also be manufactured from other light, generally rigid, materials such as aluminum or other composite materials.

Referring back to FIG. 1, the door 40 of the hydraulic operated door assembly 10 is illustrated as a bi-fold door 41. It should be noted that although other embodiments of the invention are envisioned using different types of doors, the embodiment of the bi-fold door 41 will be discussed in detail herein. The embodiment of the bi-fold door 41 illustrated in FIG. 1 can have an upper panel 42*a* and a lower panel 42*b* that are pivotally or operatively coupled together. In one embodiment, the upper panel 42*a* and the lower panel 42*b* have the same dimensions such as height and length. In other embodiments, the upper panel 42*a* and the lower panel 42*b* have different dimensions such as different heights.

Figure 3:
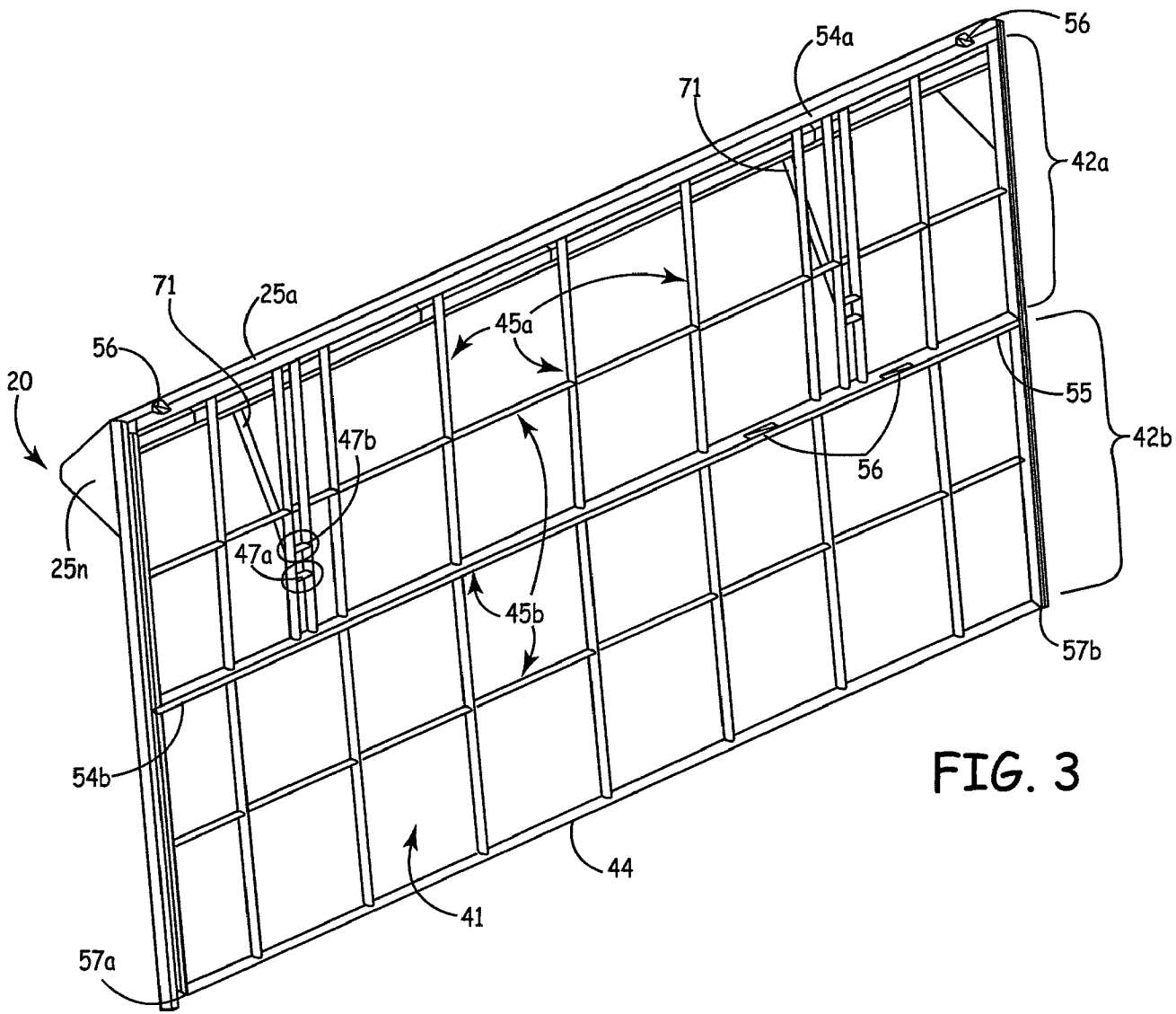
FIG. 3 is a front perspective view of a door frame mounted on a door support.

Referring now to FIG. 3, the bi-fold door 41 can include a frame 44 having a plurality of generally vertical door frame members 45*a* and a plurality of generally horizontal door frame members 45*b* that are connected by means known to one skilled in the art such as screws, bolts, adhesives and/or welding. The vertical door frame members 45*a* and the horizontal door frame members 45*b* create a grid to which a skin 46 (see FIG. 1) is attached. The skin 46 can comprise individual panels such as aluminum, steel and/or insulating material. It can also comprise one or more sheets of material such as aluminum, steel and/or insulating material. Other materials such as a wood and plastic may also be used for the skin 46. This listing of materials should be considered an example listing and thus not limiting.

Figure 4:
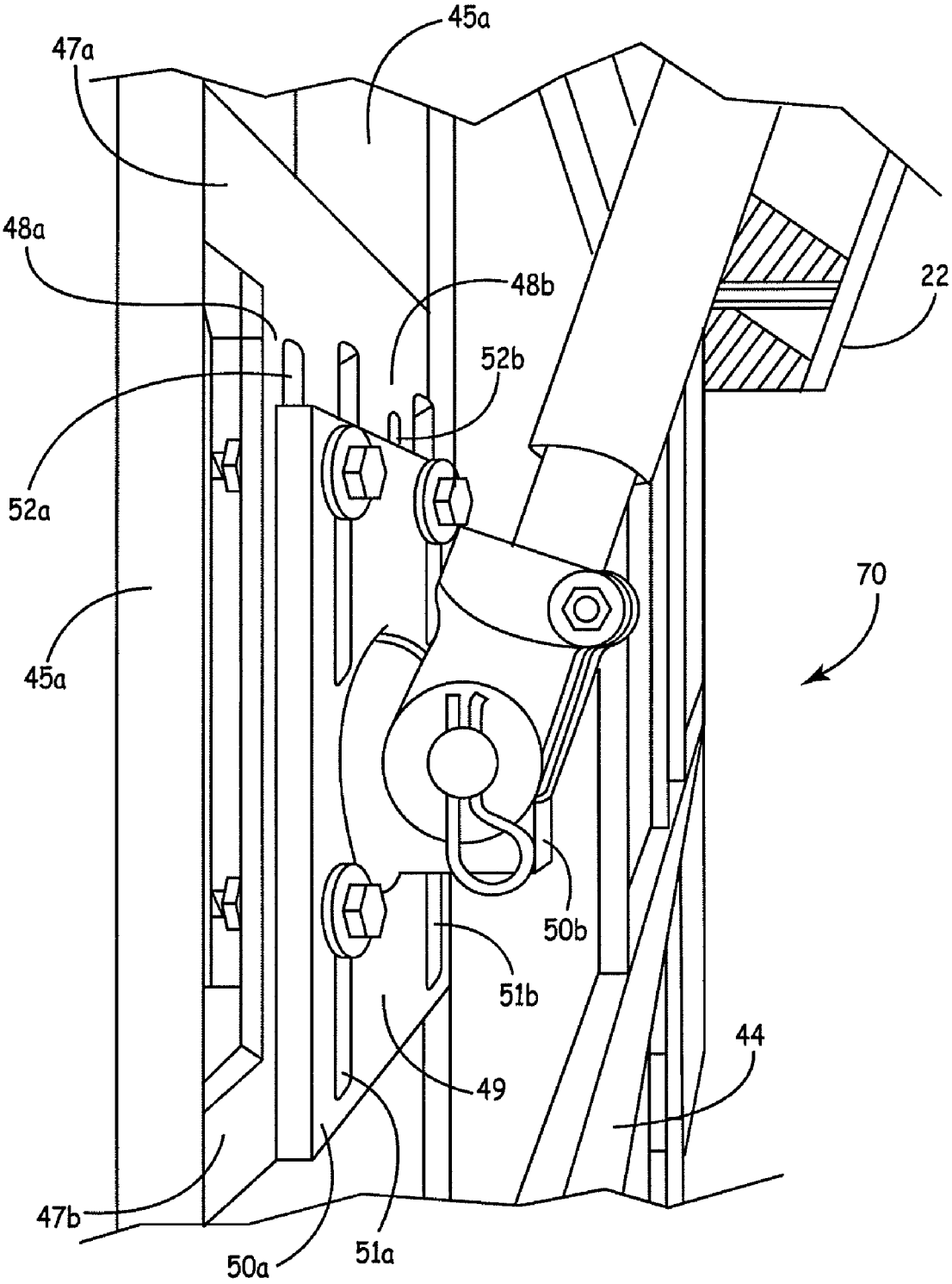
FIG. 4 is a partial perspective view of a piston rod and cylinder coupled to a bracket mounted to a door frame.

The frame 44 of the upper panel 42*a* can include generally vertical door frame members 45*a* that are spaced relatively proximate each other to form supports for attachment of a portion of the control assembly 70. Referring to FIG. 4, support braces 47*a* and 47*b* can extend between the relatively close vertical door frame members 45*a* between which extend slide rail members 48*a* and 48*b*.

As particularly illustrated in FIG. 4, a bracket 49 is adjustably connected to the slide rail members 48*a* and 48*b* by fasteners such as screws, bolts and/or nuts. The bracket 49 comprises a plate portion 50*a* and an upstanding portion 50*b* at approximate right angles to each other such that the upstanding portion 50*b* extends generally away from a surface of the frame 44. The plate portion 50*a* of the bracket 49 includes slots 51*a* and 51*b* that are in register with slots 52*a* and 52*b* extending through the slide rails 48*a* and 48*b*. The upstanding portion includes an aperture (not shown) for receiving a fastener that is used to secure the hydraulic control assembly 70 to the bracket 49. Other types of brackets can be used to attached or couple the hydraulic control assembly 70 to the frame 44. Although two brackets 49 have been illustrated, one skilled in the art will appreciate that any number of brackets 49 can be used to operatively attach the hydraulic control system 70 to the door 41.

Referring back to FIG. 3, the upper panel 42*a* has an upper edge 54*a* and a lower edge 54*b*. The upper edge 54*a* of the upper panel 42*a* can be pivotally coupled to the top beam 25*a* of the casing or door support 20. In one embodiment of the invention, hinges 56 such as barrel hinges are used to pivotally connect the upper panel 42*a* to the top beam 25*a* of the casing or door support 20. Other types of hinges can also be used to pivotally attach the upper panel 42*a* of the door 41 to the top beam 25*a* of the casing or door support 20.

The lower edge 54*b* of the upper panel 42*a* can be pivotally connected to an upper edge 55 of the lower panel 42*b* of the door 41. Hinges 56 can also be used to pivotally connect the upper panel 42*a* and the lower panel 42*b* together. All of the hinges 56 can be spaced apart along a length of the upper panel 42 and lower panel 42*b* of the door 41. In one example embodiment, the spacing between the hinges 56 can be set at approximately six (6) foot intervals or at approximately the same location as the vertical door frame 45*a* members. One skilled in the art will understand that the placement of the hinges 56 can be varied to maximize the strength and integrity of the door 41.

Figure 5A:
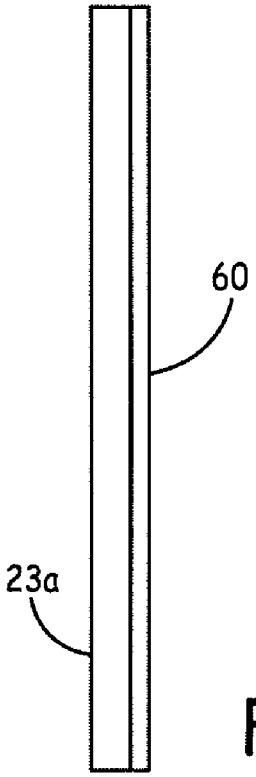
FIG. 5A is a side view of a vertical casing member according to an example embodiment of the invention.
Figure 5B:
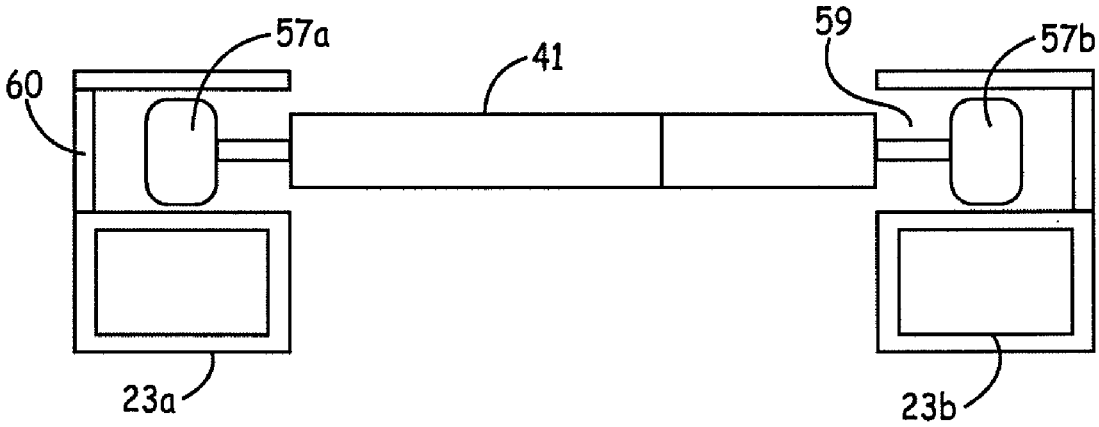
FIG. 5B is a top cross sectional view of rollers disposed in channels proximate the casing.
Figure 8:
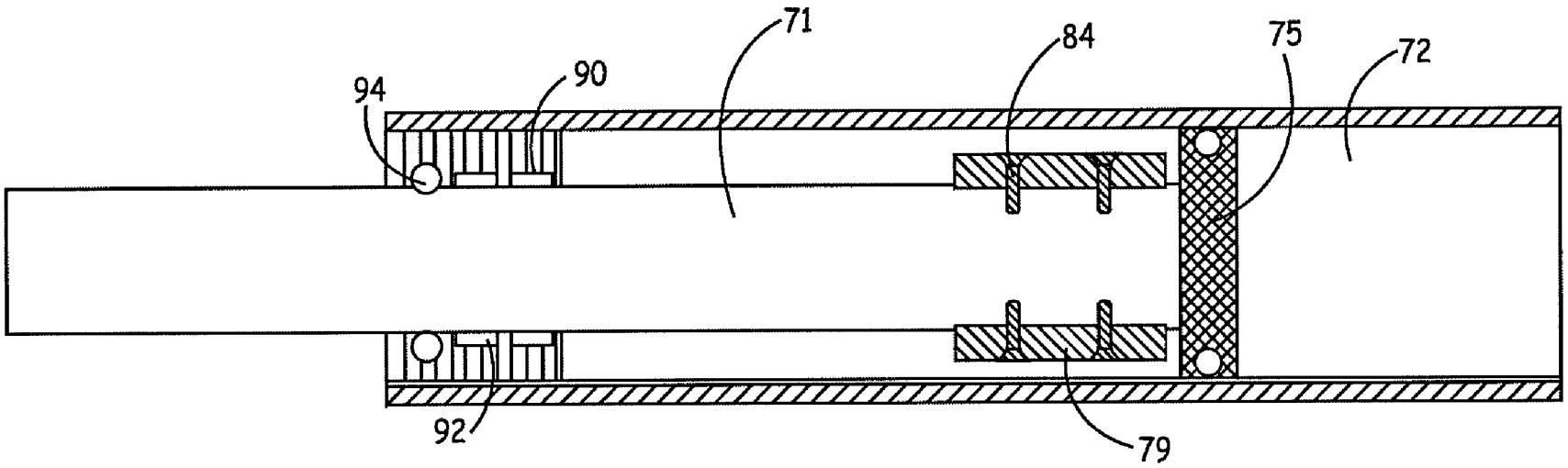
FIG. 8 is an enlarged schematic of the hydraulic control assembly with piston and cylinders connected.

Referring to FIGS. 3 and 5, the door 41 also includes at least two rollers 57*a* and 57*b* disposed proximate a lower edge 58 of the lower panel 42*b* of the door 41. Referring to FIG. 8, each of the rollers 57*a* and 57*b* is operatively disposed in a channel 59 generally adjacent to each of the vertical casing members 23*a* and 23*b*. In one embodiment, the channel 59 is formed by attaching an angled member 60 to the vertical casing members 23*a* and 23*b*. The angled member 60 attached to each of the vertical casing members 23*a* and 23*b* should have a length at least equal to a height that the rollers will travel when the door 41 moves between the closed position and opened positions.

Figure 6A:
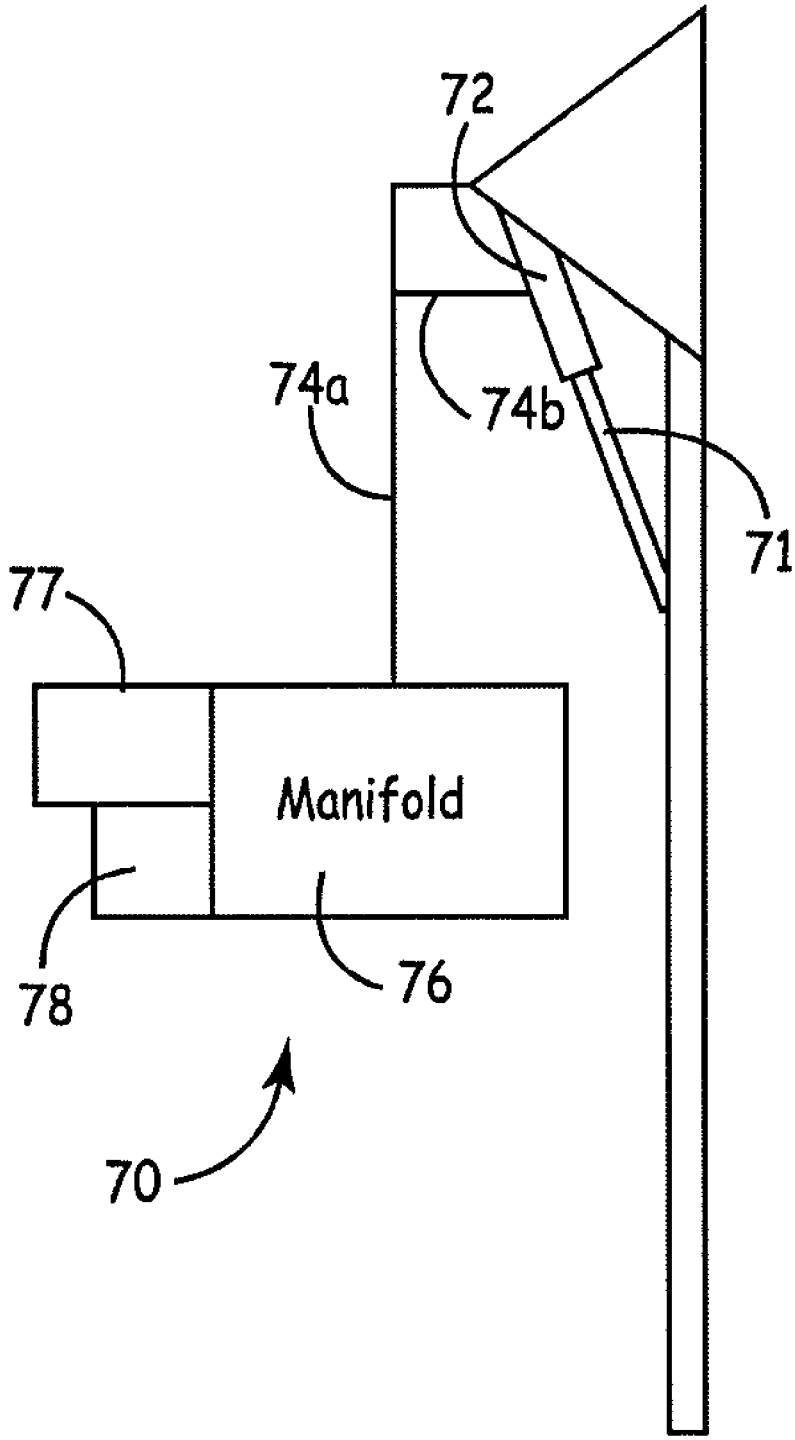
FIG. 6A is a side view of the casing and door in a closed position.
Figure 6B:
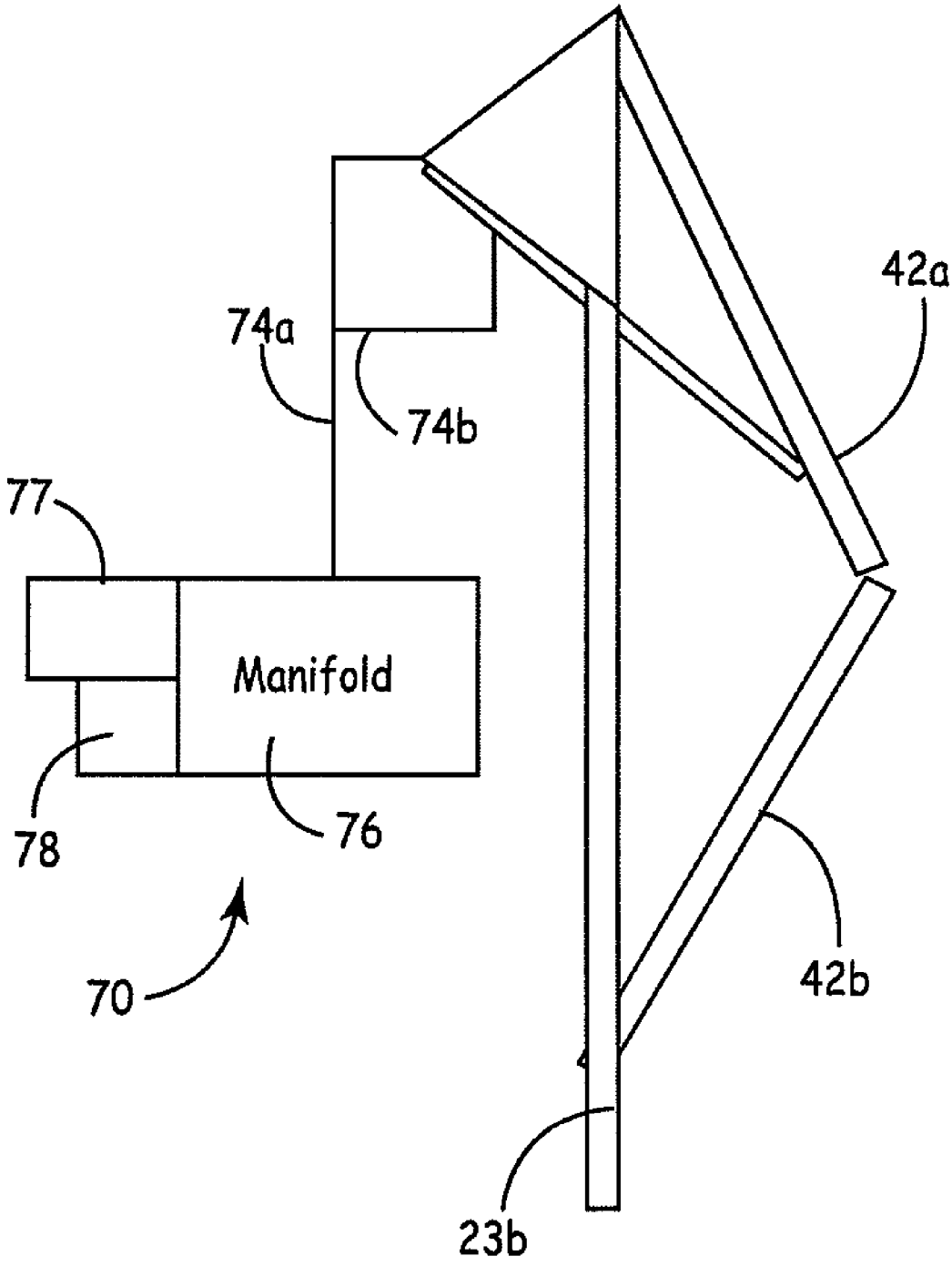
FIG. 6B is a side view of the casing and door in a partially open or closed position.
Figure 6C:
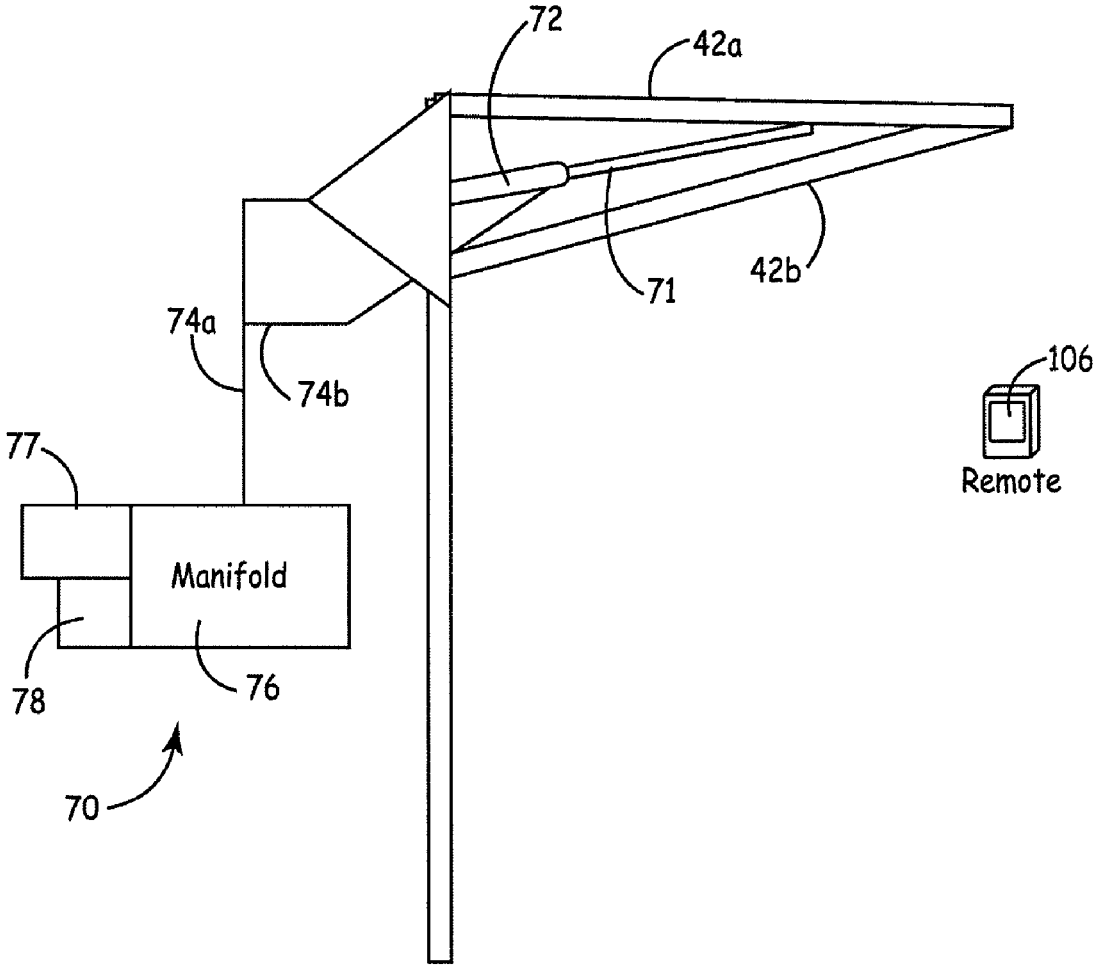
FIG. 6C is a side view of the casing and door in an open position.
Figure 7:
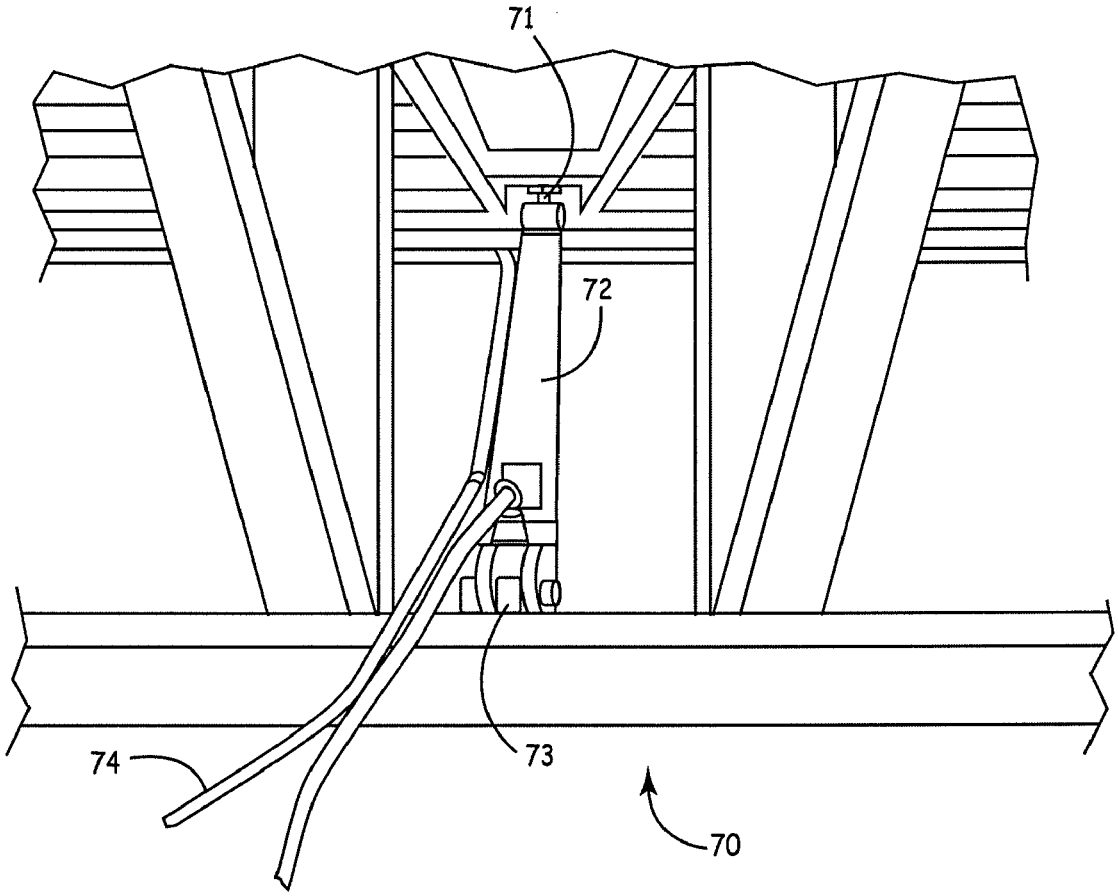
FIG. 7 is a top view of a piston and cylinder mounted between the casing and the door frame.

FIGS. 6A-6C illustrate the door 41 moving from the closed position toward the open position under the operation of the hydraulic control assembly 70 ("HCA"). In one embodiment, the HCA 70 comprises a piston rod 71 pivotally coupled to the upstanding member 50*b* of the bracket 49 (FIG. 4). The piston rod 71 is slidably disposed within a cylinder 72 that is pivotally coupled to an upstanding member 73 that is positioned between the cross supports 25*d-e* and 25*l-k* respectively of the rear beam 25*b* (see FIG. 7). The cylinder 72 is in fluid communication with hydraulic hoses 74*a* and 74*b*. The hydraulic hoses 74*a* and 74*b* are in fluid communication with a manifold 76 that controls the flow of fluid therethrough for moving the piston rod 71 and associated piston 75 between a retracted position and an extended position. Referring to FIG. 6A, when the door 41 is in the closed position the piston rod 71 is in the retracted position. Referring now to FIG. 6C, when the door 41 is in the open position the piston rod 71 is in the extended position.

Referring to FIG. 8, at least one stop 79 can be disposed in or fixed to the piston rod 71 with fasteners 84. The stop 79 can be placed at a predetermined location on the piston rod 71 to control the amount of distance the piston rod 71 can travel out of the cylinder 72. The stop 79 prevents a user from opening the door beyond the predetermined limits.

In one embodiment, the piston rod 71 is prevented from moving by the stop 79 engaging an inner surface of the cylinder 72. In another example embodiment, the piston rod 71 is prevented from moving by the stop 79 engaging at least one packing gland 85 disposed in the cylinder 72. The packing gland 85 can include a wear ring 90, a loaded u-cup 92, and a rod wiper 94 among other structures known to one skilled in the art.

Figure 9:
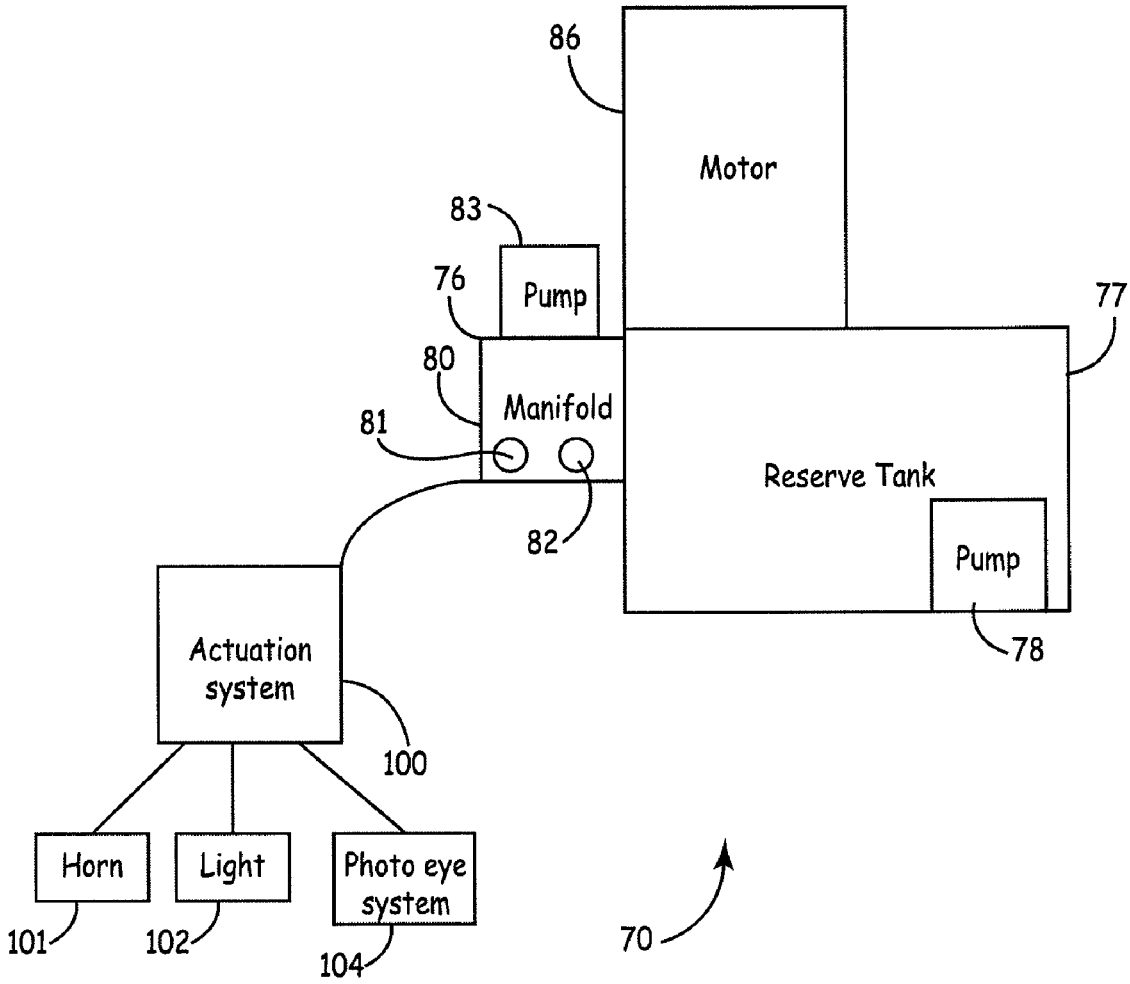
FIG. 9 is a schematic of an example control system having a manifold, fluid reservoir, motor, pumps, and an actuation system.
Figure 10:
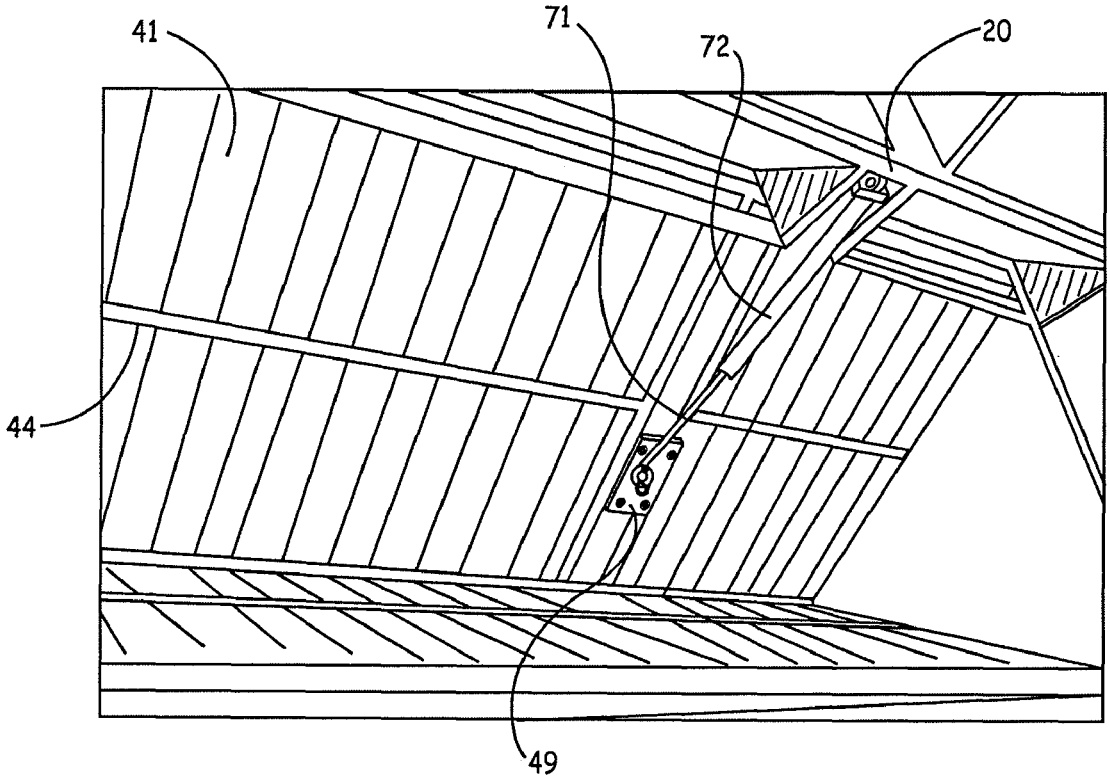
FIG. 10 is a perspective view of the door in a partially open position.

Referring to FIG. 9, the HCA 70 can also include a holding or reservoir tank 77 that is in fluid communication with the manifold 76. The holding tank 77 holds the fluid that is used to move the piston rod 71 between the retracted position and the extended position. A pump 78 is in fluid communication with the manifold 76 and the holding tank 77 for moving the fluid throughout the assembly 70.

Manifold 76, as illustrated in FIG. 9 can include a valve body 80. The valve body 80 can contain a pressure relief valve 81 to provide a means of controlling the release of fluid. If pressure inside of the manifold 76 increases beyond a predetermined limit the pressure relief valve 81 will release the fluid.

If power to the HCA 70 fails, a user can manually actuate a control valve 82 to slowly lower the door 41 from the open position toward the closed position. Additionally, if the power fails a manual pump 83, operatively coupled to or integral with the manifold 76, can be used to allow a user to raise the door 41. In one embodiment, the manual pump 83 can be operated by hand or by a backup battery.

Referring to FIGS. 11 and 12*a-f*, the manifold 76 also houses at least one check valve (not shown) for controlling the direction of the fluid through the HCA 70. In other embodiments, multiple check valves are used in the manifold 76 to control the flow of fluid therethrough.

As illustrated in FIG. 9, a motor 86 can be connected to the pump 78 to control the fluid entering the manifold 76. In one embodiment, the pump 78 and the motor 86 can be disposed proximate the reservoir tank 77 and in fluid communication with the manifold 76.

The manifold 76 can also have a counterbalance valve, a needle valve with free reverse, a solenoid valve, and a DIN connector. Other fluid regulating, measuring and control components known to those skilled in the art can be connected to or integrated with the manifold 76.

Although multiple embodiments of the hydraulic control system are possible, for example, the embodiment shown in FIG. 9 illustrates the fluid reservoir 77 mounted adjacent to the manifold 76 and motor 86. Other embodiments are also possible and should be considered to be within the spirit and scope of the invention.

FIG. 9 also illustrates that the manifold 76 derives its power from, and is controlled by, an actuation system 100. Referring to FIG. 14, the actuation system 100 can also control the motor 86, a horn 101 that sounds when the door 41 is in operation and/or a light 102 that illuminates when the door 41 is in operation. The control actuation system 100 can also control a photo eye system 104 which can stop movement of the door if a beam sent there between is broken.

In one embodiment, the door 41 can be controlled by a remote device 106 that communicates with a radio receiver 107 that is in communication with the actuation system 100. The remote device 106 can allow a user to open and close the door 41 along with a variety of other functions such as controlling lights.

In use, the manifold 76 can control the flow of fluid into a rear portion of the cylinder(s) 72. The fluid forces the piston rod 71 to move from the retracted position toward the extended position. As the piston rod 71 moves toward the extended position a central portion of the bi-fold door 41, where the upper panel 42*a* and the lower panel 42*b* are coupled together, moves outwardly away from the structure 12. As the piston rod 71 continues toward its extended position, the upper panel 42*a* is lifted upwardly causing the rollers 57*a* and 57*b* connected to the lower panel 42*b* to travel in the channels 59 from the ground toward the truss 22.

Once the piston rod 71 reaches it's permitted outermost extended position, the upper panel 42*a* and the lower panel 42*b* form a wedge with the opening 15 of the structure 12 being generally unobstructed. The wedge formed by the upper panel 42*a* and the lower panel 42*a* provides structural rigidity against wind and other weather conditions. The truss 22 absorbs most of the force reducing the force upon the structure 12.

During movement of the bi-fold door 41 between the closed position and the open position, the cylinder 72 pivots on a portion of the truss 22 and travels in the channels 28*a* and 28*b* defined by the cross supports 25*d*-25*e* and 25*l*-25*k*. Likewise, the piston rod 71 pivots on the bracket 49 that is adjustably connected to the frame 44 of the bi-fold door 41 (See FIG. 4).

To close the door 41 the manifold 76 directs the fluid into the front portion of the cylinder 72 which causes the piston rod 71 to retract. As the piston rod 71 retracts the upper panel 42*a* of the door 41 is gradually lowered. The lowering of the upper panel 42*a* permits the lower panel 42*b* to lower and concurrently the rollers 57*a* and 57*b* to travel in the channels 59. Once the piston rod 71 is completely retracted it acts as a lock on the door 41 pulling the central portion of the upper panel 42*a*, and thus the lower panel 42*b*, securely against the casing or door support 20. Therefore, a separate lock, although can be used, is not necessary to keep the bi-fold door 41 securely closed.

In addition to the stops 79 in the cylinders 72, stops can also be placed in the channels 59 to stop the rollers 57*a* and 57*b* from traveling above a predetermined height. These stops 79 can be plates or any other structure disposed within the channel 59. To prevent the door 41 from closing too quickly, a safety valve can be disposed in each of the cylinders 72 to stop the piston rod 71 from moving if there is an increase in the velocity of the fluid moving within the system. If there is an increase in the velocity, for example by a ruptured hose, the safety valve can shut off and the door 41 stops moving. Other safety components and features are also possible and should be considered to be within the spirit and scope of the invention.

The invention may be embodied in these and other specific forms without departing from the spirit or attributes thereof, and it is therefore desired that the embodiments be considered in all respects as illustrative and not restrictive, reference being made to the appended claims rather than to the foregoing description to indicate the scope of the invention.

What is claimed is:

1. A multi-panel door and door support assembly for a building structure defining an opening for a door with a header above the opening, comprising:

a horizontal support member positioned proximate to and substantially along the length of the header;

the horizontal member comprises a truss having a plurality of interconnected horizontal members, wherein the upper panel of the multi-panel door is pivotally coupled to one of the horizontal members;

a multi-panel door having at least an upper panel directly pivotally coupled to the horizontal member defining an upper panel pivot axis and a lower panel pivotally coupled to the upper panel defining a lower panel pivot axis;

guide rails positioned along sides of the door opening for operatively engaging side edges of the upper and lower panels;

guides coupled to at least the lower panel and operatively engaging the guide rails to control a path of travel of at least an end of the lower panel; and a control assembly including a hydraulic cylinder and a piston rod slidably mounted in the cylinder for movement between a retracted and extended position and having a longitudinal axis, wherein a first end of the cylinder assembly is pivotally secured to the truss and a second end of the control assembly is directly pivotally secured to either the upper or lower panel proximate the lower panel pivot axis defining a control assembly/panel pivot axis, to control the movement of the multi-panel door between an open position and a closed position upon movement of the cylinder rod between its extended and retracted positions;

the truss having channels between the horizontal members, wherein the piston rod and cylinder travel in the channels as the mutli-paneled door travels between the open and closed positions.

2. The multi-panel door and door support assembly of claim 1, wherein the piston rod and cylinder are in fluid communication with the control assembly.

3. The multi-panel door and door support assembly of claim 1, further comprising first and second vertical support frame members attachable to jambs of the door opening, wherein the guide rails are formed into the first and second vertical support frame members.

4. The multi-panel door and door support assembly of claim 1, wherein the cylinder is pivotally coupled to one of the horizontal members and the piston rod is pivotally coupled to one of the panels of the multi-panel door.

5. The multi-panel door and door support assembly of claim 4, wherein the control assembly includes a bracket adjustably coupled to the upper panel for pivotally engaging the piston rod.

6. The multi-panel door and door support assembly of claim 5, wherein the control assembly includes door frame members spaced relatively proximate each other for supporting the control assembly bracket.

7. The multi-panel door and door support assembly of claim 5, wherein the bracket comprises a plate having slots that are in register with slots extending through a portion of the door frame members.

8. The multi-panel door and door support assembly of claim 1, wherein at least the upper panel and lower panel have identical heights.

9. The multi-panel door and door support assembly of claim 1, wherein at least the upper panel and the lower panel have different heights.

10. The multi-panel door and door support assembly of claim 1, wherein the guides include a roller rotatably coupled to a pin disposed proximate to a lower edge of the lower panel.

11. The multi-panel door and door support assembly of claim 2 further comprising at least one stop disposed in the cylinder to restrict a distance that the piston rod can be extended.

12. The multi-panel door and door support assembly of claim 1, wherein the control assembly is automatically operated to raise and lower the multi-panel door.

13. The multi-panel door and door support assembly of claim 1, wherein the control assembly is manually operated to raise and lower the multi-panel door.

14. The multi-paneled door and door support assembly of claim 1, further comprising a first casing member and a second casing member connected to and extending downwardly from the truss to guide the multi-panel door between the open and closed position.

15. The multi-paneled door and door support assembly of claim 1, wherein the truss comprises a top beam disposed to ends of vertical members, a rear beam connected to the top beam by a plurality of angled supports, wherein a portion of the multi-panel door is pivotally coupled to a portion of the top beam.

16. The multi-paneled door and door support assembly of claim 1, wherein the horizontal members of the truss includes a top beam disposed to ends of vertical members, a rear beam connected to the top beam by a plurality of first angled supports, and a plurality of second angled supports connecting the rear beam and a first casing member and a second casing member respectively, wherein the multi-panel door is pivotally coupled to a portion of the top beam.

* * * * *

UNITED STATES PATENT AND TRADEMARK OFFICE

CERTIFICATE OF CORRECTION

PATENT NO. : 7,814,957 B2
APPLICATION NO. : 11/781789
DATED : October 19, 2010
INVENTOR(S) : David A. Crown It is certified that error appears in the above-identified patent and that said Letters Patent is hereby corrected as shown below:

Column 8, Claim 15, line 2, "wherein the truss" should be -- wherein the horizontal members of the truss --.

Signed and Sealed this

Fourteenth Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,814,957 B2
APPLICATION NO. : 11/781789
DATED : October 19, 2010
INVENTOR(S) : David A. Crown It is certified that error appears in the above-identified patent and that said Letters Patent is hereby corrected as shown below:

Column 8, line 44 (Claim 15, line 2) "wherein the truss" should be -- wherein the horizontal members of the truss --.

This certificate supersedes the Certificate of Correction issued December 14, 2010.

Signed and Sealed this
Fourth Day of January, 2011

David J. Kappos
*Director of the United States Patent and Trademark Office*